US006039607A

United States Patent [19]

Cheung

[11] Patent Number: 6,039,607

[45] Date of Patent: Mar. 21, 2000

[54] ELECTRIC PLUG

[75] Inventor: Tat Kwong Cheung, Kowloon, The Hong Kong Special Administrative Region of the People's Republic of China

[73] Assignee: Top Power Supply Cord Set Co, Limited, The Hong Kong Special Administrative Region of the People's Republic of China

[21] Appl. No.: 09/210,838

[22] Filed: Dec. 15, 1998

[51] Int. Cl.[7] ..... H01R 13/68

[52] U.S. Cl. ..... 439/622

[58] Field of Search ..... 439/622, 621; 337/255, 198

[56] References Cited

U.S. PATENT DOCUMENTS

| | | | |
|---|---|---|---|
| 4,679,884 | 7/1987 | Klemp | 439/622 |
| 4,978,318 | 12/1990 | Wiley et al. | 439/536 |
| 5,435,755 | 7/1995 | Chien et al. | 439/622 |
| 5,643,012 | 7/1997 | Mai et al. | 439/622 |
| 5,716,219 | 2/1998 | Noike | 439/31 |

FOREIGN PATENT DOCUMENTS

| | | | |
|---|---|---|---|
| 87207492U | 5/1988 | China . | |
| 90215005 | 5/1991 | China . | |
| 89109751 | 7/1991 | China . | |
| 92221271 | 4/1993 | China . | |
| 92222609 | 5/1993 | China . | |
| 96230922 | 12/1997 | China . | |
| 02253578A | 10/1990 | Japan . | |
| 07296898A | 11/1995 | Japan . | |
| 09147959A | 6/1997 | Japan . | |
| 2082851 | 3/1982 | United Kingdom | 439/622 |
| 2189946 | 11/1987 | United Kingdom | 439/622 |

*Primary Examiner*—Gary F. Paumen
*Attorney, Agent, or Firm*—Burns, Doane, Swecker & Mathis, L.L.P.

[57] ABSTRACT

There is disclosed an electric plug including a body member to which switches and two electrically conductive legs are mounted, in which an electric cable including at two electric wires is connectable to the body member, and the legs are electrically connectable to a source of electricity, in which one of the electrically conductive legs is electrically conectable in series with one of the elelctric wires via a fuse which is releasably attachable to and movable with the switches, and the switches are operable to move the fuse between a position in which the fuse is in electrical connection with the leg, and a position in which the fuse is out of electrical connection with the leg.

10 Claims, 11 Drawing Sheets

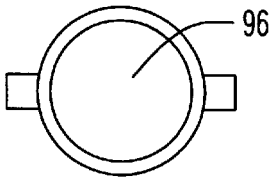
FIG. 16A
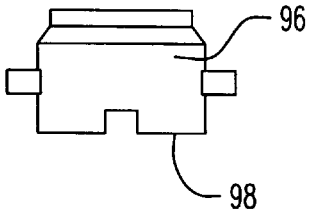
FIG. 16B
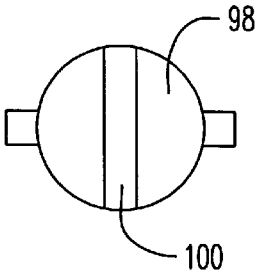
FIG. 16C
FIG. 17A
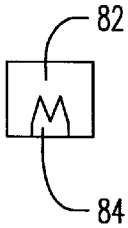
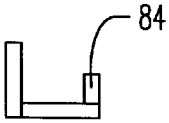
FIG. 17B
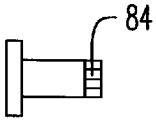
FIG. 17C

ELECTRIC PLUG

This invention relates to an electric plug and, in particular, an electric plug allowing safe and easy installation and replacement of fuse.

BACKGROUND OF THE INVENTION

In a conventional electric plug installed with a fuse, the fuse is usually protected by a cover which may be removed from the plug, thus allowing the fuse in the plug to be replaced. However, it is possible to remove this cover while the electric plug is in use, i.e. still electrically connected to an electric source. This poses a threat to a user or technician who is to replace the fuse. Metallic contacts with which the fuse is to contact are also exposed to the environment when the cover is opened. In case there is no fuse available for replacement, the user or technician may simply use a metal wire to connect these metallic contacts, and thus to establish electrical connection therebetween. The protective function of the fused-provided electric plug is thus negated. It is thus an object of the present invention to provide an improved electric plug in which the aforesaid shortcomings are mitigated, or at least to provide a useful alternative to the public.

SUMMARY OF THE INVENTION

In accordance with a first aspect of the present invention, there is provided an electric plug comprising a body member to which switching means and at least first and second electrically conductive leg members are mounted, wherein an electric cable comprising at least first and second electric wires is connectable to said body member, wherein said leg members are electrically connectable to a source of electricity, wherein said first leg member is electrically connectable in series with said first electric wire via a fuse member releasably attachable to and movable with said switching means, and wherein said switching means is operable to move said fuse member between a first position in which said fuse member is in electrical connection with said first leg member, and a second position in which said fuse member is out of electrical connection with said first leg member.

In accordance with a second aspect of the present invention, there is provided an electric plug comprising a body member to which switching means and an electric cable comprising at least first and second electric wires are mounted, wherein an electric cable comprising at least first and second electric wires is connectable to said body member, wherein said leg members are electrically connectable to a source of electricity, wherein said first leg member is electrically connectable in series with said first electric wire via a fuse member releasably attachable to said switching means, wherein said switching means is movable between a first position in which said first wire is in electrical connection with said first leg member, and a second position in which said first wire is out of electrical connection with said first leg member, and wherein said fuse member is removable from said body member only when said switching means is in said second position.

BRIEF DESCRIPTION OF THE DRAWINGS

A preferred embodiment of the invention will now be described by way of an example only and with reference to the accompanying drawings, in which:

FIG. 16A shows a top view of the cover member of the housing member shown in FIG. 8A;

FIG. 16B is a side view of the cover member shown in FIG. 16A;

FIG. 16C is a bottom view of the cover member shown in FIG. 16A;

FIG. 17A is a back view of the wire-engagement member shown in FIG. 15A;

FIG. 17B is a side view of the wire-engagement member shown in FIG. 17A; and FIG. 17C is a top view of the wire-engagement member shown in FIG. 17A.

DETAILED DESCRIPTION OF THE PREFERRED EMBODIMENT

Figure 2:
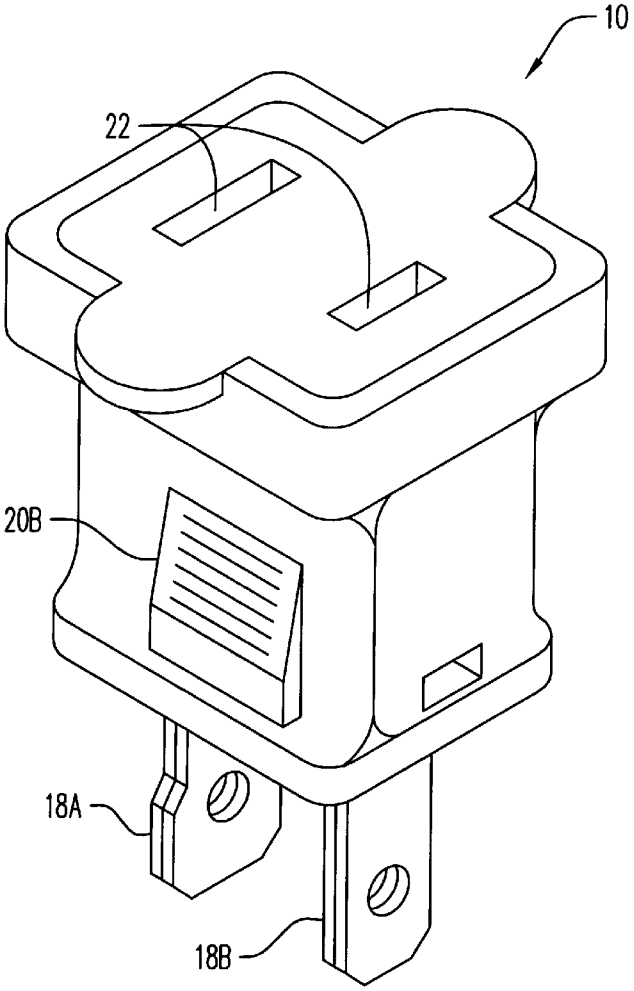
FIG. 2 shows a right perspective view of the electric plug shown in FIG. 1.
Figure 1:
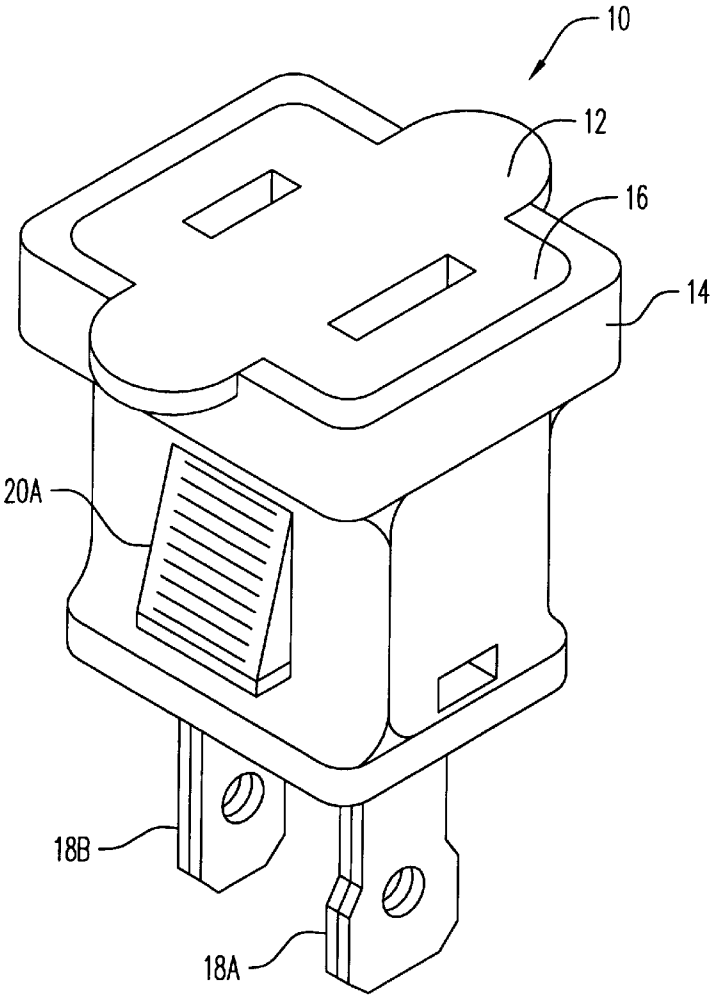
FIG. 1 shows a left perspective view of an assembled electric plug according to the present invention.

A preferred embodiment of an electric plug according to the present invention is shown in FIGS. 1 and 2 and generally designated as 10. The electric plug 10 has a body member 12 consisting of a housing 14 and a core member 16 which are engageable with each other in a manner to be discussed below. Extending from the bottom of the body member 12 of the plug 10 are two electrically conductive leg members 18A, 18B, which may be electrically connected to a source of electricity (not shown). On two opposite sides of the body member 12 are two switch parts 20A, 20B. On the top of the core member 16 are two apertures 22, into which electrically conductive legs of another plug, or of an electrical appliance, may be inserted in order to obtain electricity from the source of electricity.

As can be seen in FIGS. 3, 4A, 4B and 4C, the housing 14 has a substantially rectangular body 24 made of four upstanding walls 26 with an open upper end. On two of the opposite walls 26 are a respective rectangular hole 28. These rectangular holes 28 are for receiving part of the respective switch member 20A, 20B. The four walls 26 are joined at the lower end to a floor member 30, and at the upper end to a wider rim 32. On two opposite sides of the rim 32 is a respective stepped region 34A, 34B. It can be seen that while the region 34A is a one-stepped, the region 34B is two-stepped, including an upper step 36A, and a lower step 36B. The stepped region 34A and the upper step 36A of the stepped region 34B are for receiving and engaging with part of the core member 16, to be discussed below. As to the space between the upper step 36A and the lower step 36B of the stepped region 34B, such is to allow for the extension of an electric cable therethrough, and into the core member 16, in a manner to be discussed below.

The floor member 30 and the four walls 36 define a cavity into which the core member 16 may be received. The floor member 30 of the housing 14 includes two elongate apertures 38 through which electrically conductive leg members 18A, 18B carried by the core member 16 may extend. The floor member 30 all includes a substantially circular opening 40 the function of which will be discussed below.

Figure 5:
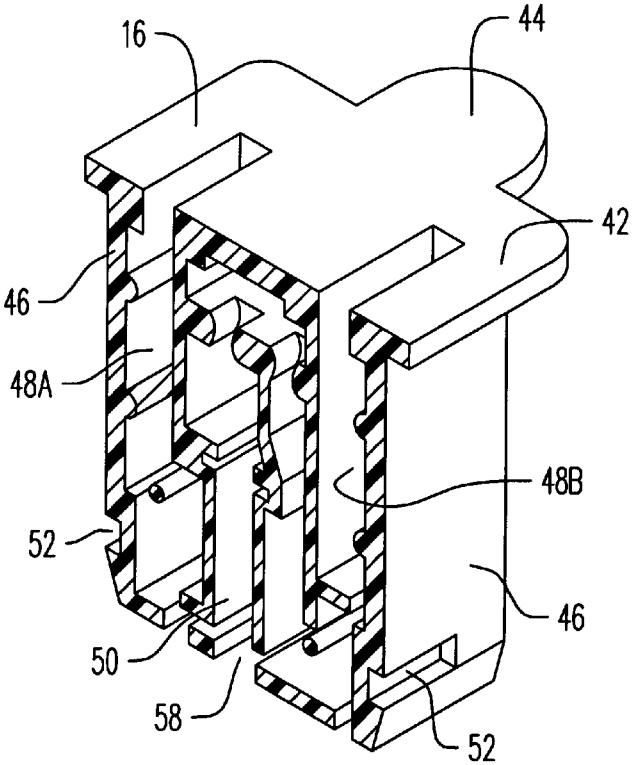
FIG. 5 shows a half-sectional perspective view of the core member of the electric plug shown in FIG. 1.
Figure 3:
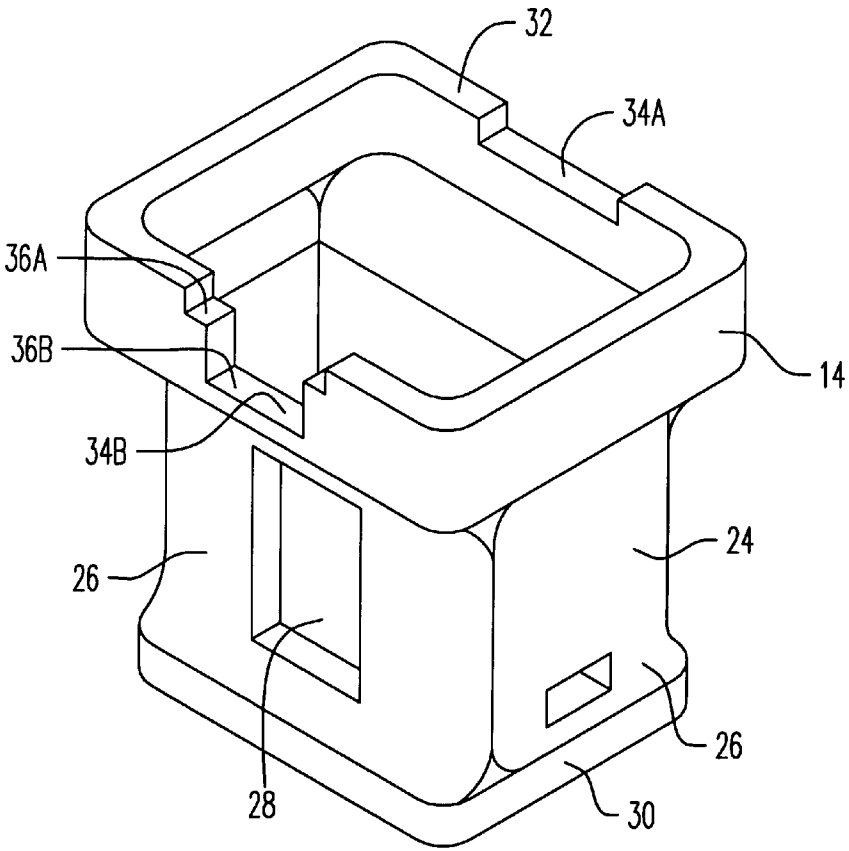
FIG. 3 shows a perspective view of the housing member of the electric plug shown in FIG. 1.
Figure 4C:
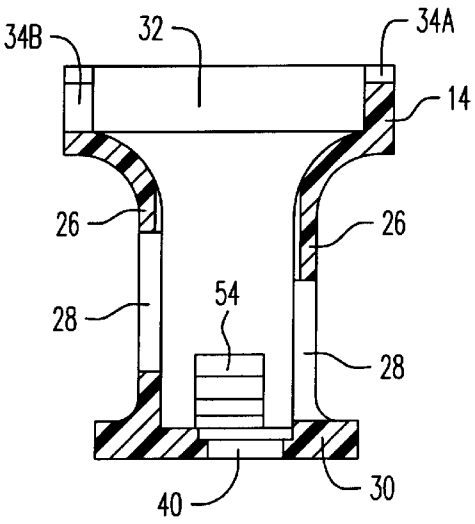
FIG. 4C shows a sectional view of the housing member taken along the line 11—II in FIG. 4A.
Figure 4B:
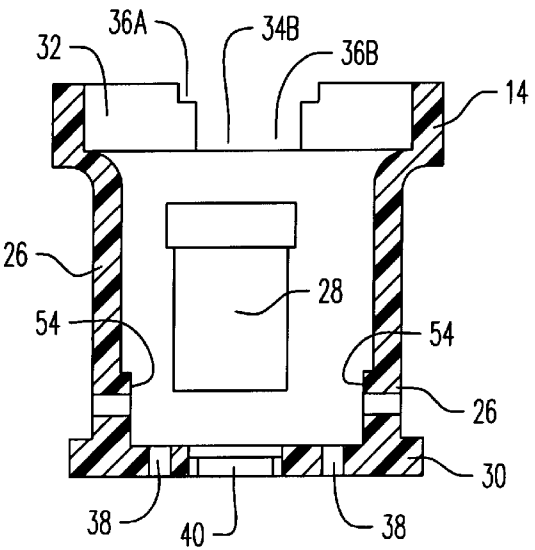
FIG. 4B shows a sectional view of the housing member taken along the line I—I in FIG. 4A.
Figure 4A:
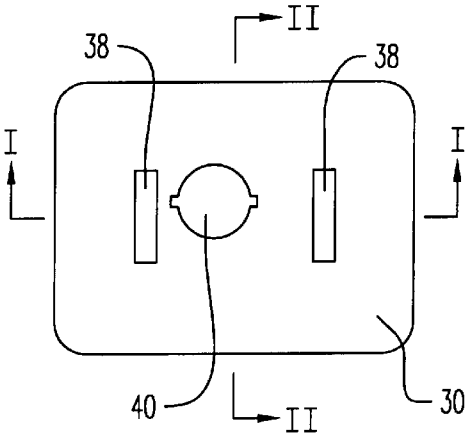
FIG. 4A shows a bottom view of the housing member shown in FIG. 3.

FIG. 5 shows a longitudinal half-sectional view of the core member 16. It can be seen that on the top part 42 of the core member 16 such includes two opposite semi-circular protrusions 44 which, when the core member 16 is engaged with the housing 14, sit on the stepped region 34A, and the upper step 36A of the stepped region 34B. The core member 16 includes four walls 46. Provided in the core member 16 are two substantially elongate cavities 48A and 48B for receiving a respective part of the electrically conductive leg members 18A, 18B. Also provided in the core member 16 is a fuse cavity 50 for receiving a fuse (to be discussed below). On two opposite walls 46 of the core member 16 are each a recessed region 52 which, when the core member 16 is engaged with the housing 14, receives a respective protruding portion 54 on the inner surface of two walls 26 of the housing 14, in order to secure the core member 16 to the housing 14. The core member 16 also includes a floor member 56 allowing the extension of the electrically conductive leg members 18A, 18B therethrough. There is also a hole 58 which allows the fuse member (to be discussed below) to pass through, and thus out of the core member 16.

Figure 6:
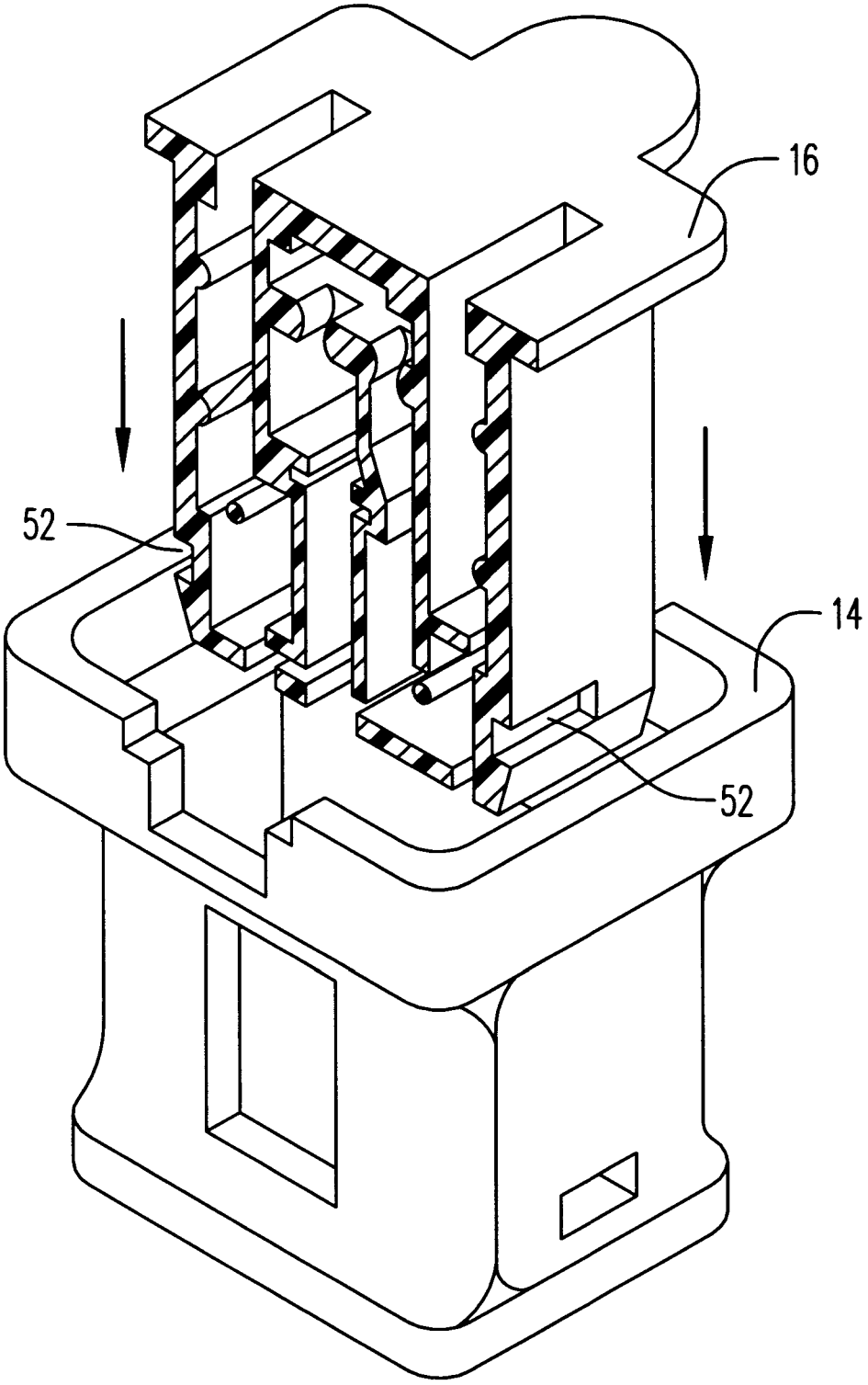
FIG. 6 shows an exploded view of the electric plug shown in FIG. 1, with the core member half-sectioned.

As shown in FIG. 6, the core member 16 is insertable into the cavity of the housing 14 through open upper end of the housing 14. Once the core member 16 is fully inserted into the housing 14, the protrusions 54 of the housing 14 will be engaged with the recessed regions 52 of the core member 16. Once the core member 16 and the housing 14 are secured to each other, it is not possible to separate them again.

Figure 13A:
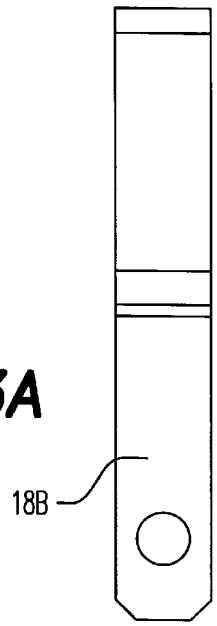
FIG. 13A shows a side view of the first leg member of the electric plug shown in FIG. 1.
Figure 13B:
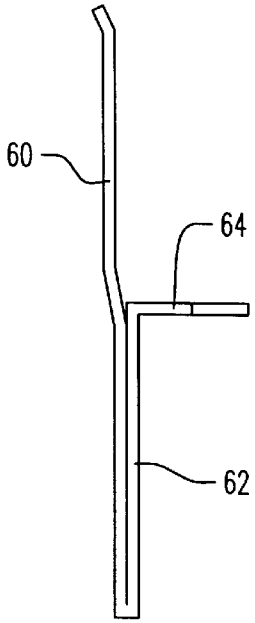
FIG. 13B shows a front view of the first leg member shown in FIG. 13A.
Figure 13C:
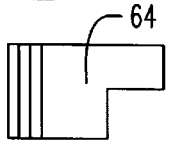
FIG. 13C shows a top view of the first leg member shown in FIG. 13A.

Referring now to FIGS. 13A to 13C, such show various views of the electrically conductive leg member 18B. The whole leg member 18B is made of copper and includes an elongate portion 60 secured to an angled portion 62. The angled portion 62 includes a platelet 64 which will be in contact with the fuse when the fuse is installed into the electric plug 10.

Figure 14A:
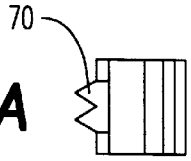
FIG. 14A shows a top view of the second leg member of the electric plug shown in FIG. 1.
Figure 14B:
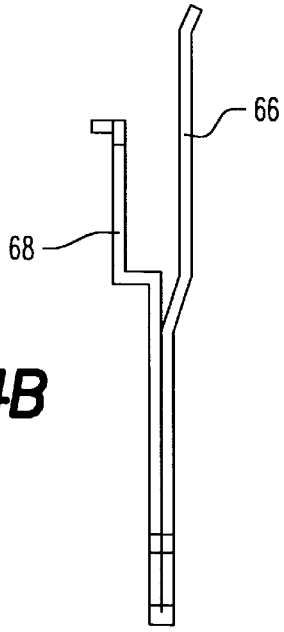
FIG. 14B shows a front view of the second leg member shown in FIG. 14A.
Figure 14C:
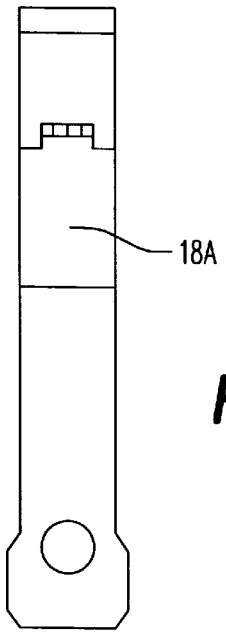
FIG. 14C shows a side view of the second leg member shown in FIG. 14A.
Figure 15C:
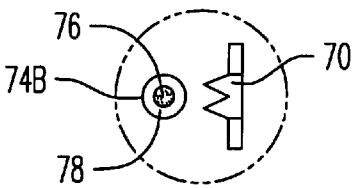
FIG. 15C shows a plan view of the encircled portion marked "B" in FIG. 15A.
Figure 15A:
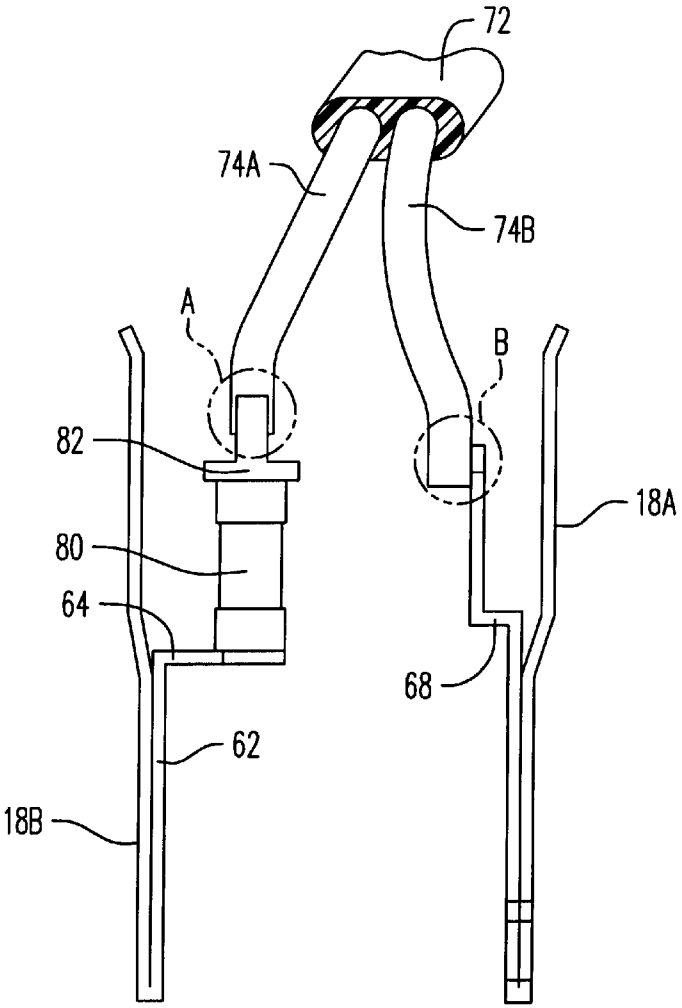
FIG. 15A shows the engagement between the electric cable with the two leg members in the electric plug shown in FIG. 1.
Figure 15B:
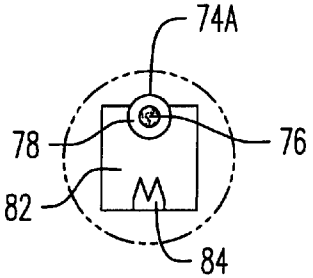
FIG. 15B shows a plan view of the encircled portion marked "A" in FIG. 15A.

As to the electrically conductive leg member 18A, its various views are shown in FIGS. 14A to 14C. Again, this leg member 18A is made of copper and includes an elongate portion 66 secured to an angled portion 68. At the upper end of the angled portion 68 is a teeth member 70 which is to engage with an electric wire of an electric cable in the manner as shown in FIGS. 15A to 15C. As can be seen in FIGS. 15A to 15C, an electric cable 72 contains two electric wires 74A, 74B. Each of the electric wires 74A, 74B contains a number of electrically conductive materials, e.g. copper wires 76, covered by a layer of electrically insulating material, e.g. an insulating plastics layer 78. As shown in FIG. 15A, on end of a fuse 80 sits on and is thus in electrical connection with the platelet 64 of the angled portion 62 of the electrically conductive leg member 18B. Another end of the fuse 80 is in contact with a electrically conductive wire-engagement member 82, which is to be engaged with the electric wires 74A.

Turning now to FIG. 15B, it can be seen that the wire-engagement member 82 includes a teeth member 84. In this connection, FIGS. 17A to 17C show various views of the wire-engagement member 82. While FIG. 15B shows the electric wire 74A and the wire-engagement member 82 not in an engaged position, when the wire 74A is pushed against the wire-engagement member 82, the teeth member 84 will penetrate through the layer of insulating plastics layer 78 and come into physical and electrical contact with the copper wires 76 inside. In such a position, the leg member 18B is electrically connected in series with the electric wire 74A via the fuse 80. As to FIG. 15C, the teeth member 70 of the angled portion 68 of the electrically conductive leg member 18A is also engageable with the wire member 74B in a likewise manner.

Figure 8:
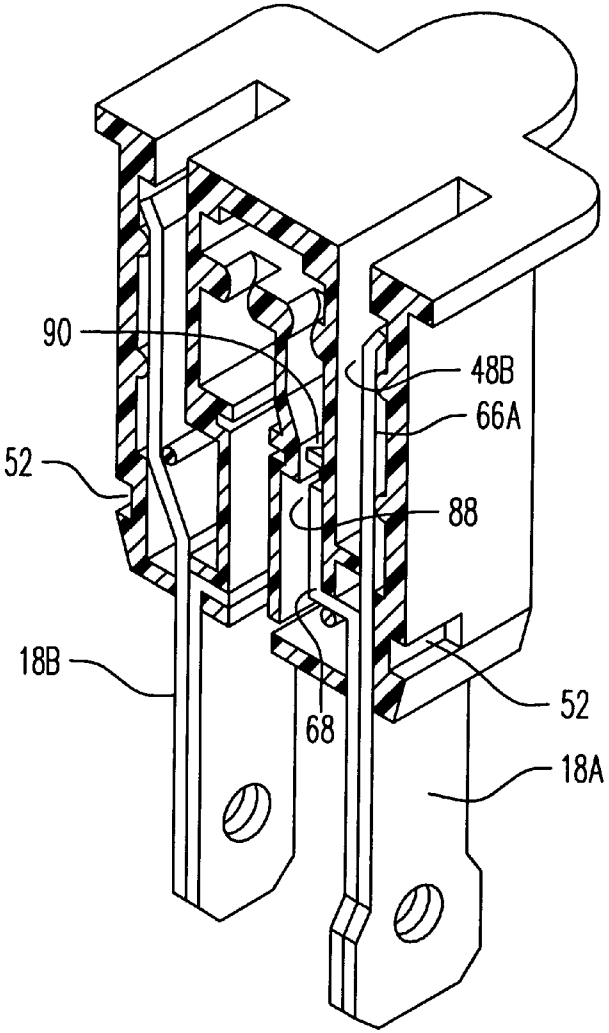
FIG. 8 shows a half-sectional view of the core member shown in FIG. 5 with the leg members attached.
Figure 7:
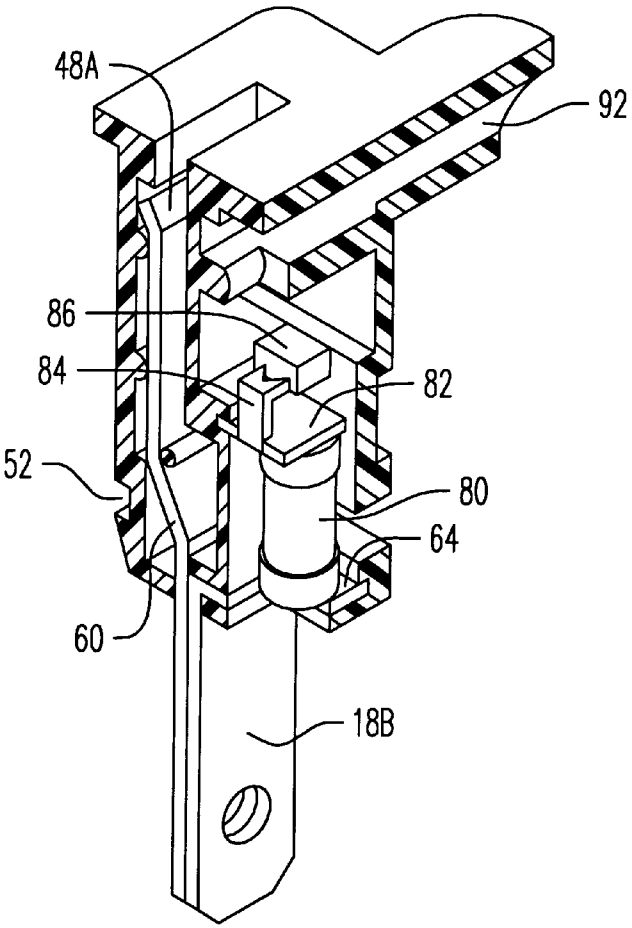
FIG. 7 shows a quarter-sectional view of the core member shown in FIG. 5 with the fuse member and a leg member attached.

It can be seen more clearly in FIGS. 7 and 8 that the elongate portion 60 of the leg member 18B extends into the cavity 48A of the core member 16. The platelet 64 of the angled portion 62 of the leg member 18B is in contact with the fuse 80. Another end of the fuse 80 is in contact with the wire-engagement member 82. A wire block 86 is provided adjacent to the wire-engagement member 82. The electric wire 74A is to extend through the space between the teeth member 84 of the wire-engagement member 82 and the wire block 86. The elongate portion 66 of the leg member 18A extends into the cavity 48B of the core member 16. As to the angled portion 68, such extends into a cavity 88 of the core member 16. Situated next to the teeth member 70 of the leg member 18A is a wire block 90, which co-operate with the teeth member 70 to position the electric wire 74B therebetween, in order to ensure that the teeth member 70 is properly engaged with the electric wire 74B. It can also be seen in FIG. 7 that near the top of the core member is a channel 92 which allows the electric cable 72 to pass through in order to establish electrical contact with the leg members 18A, 18B in the manner discussed above.

Figure 9A:
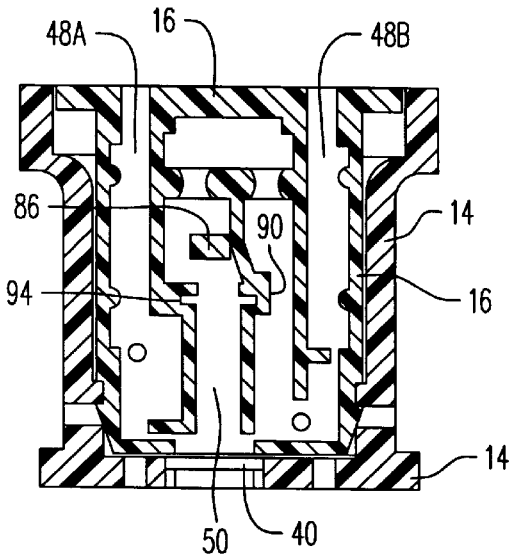
FIG. 9A shows a front half-sectional view of the electric plug shown in FIG. 1, with the fuse member, switch member and leg members removed for clarity purposes.
Figure 9B:
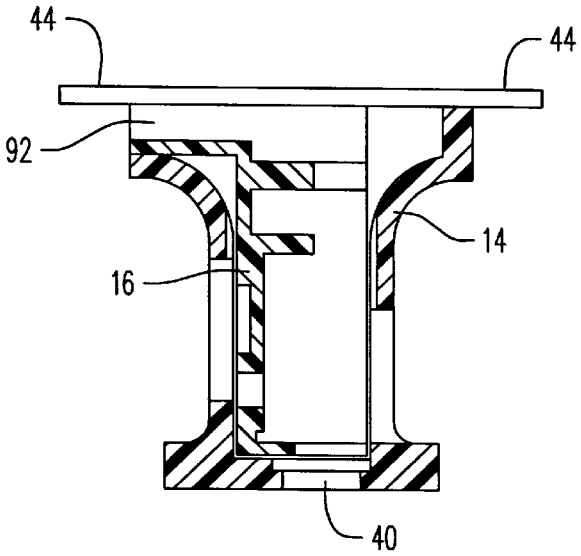
FIG. 9B shows a side sectional view of the electric plug shown in FIG. 9A.
Figure 9C:
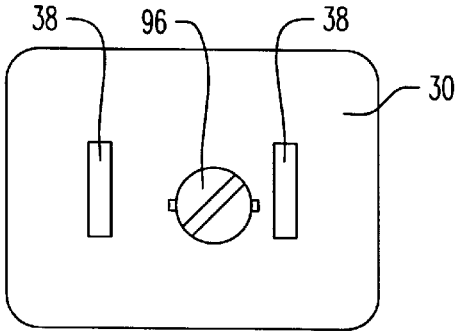
FIG. 9C shows a bottom view of the electric plug shown in FIG. 9A.
Figure 9D:
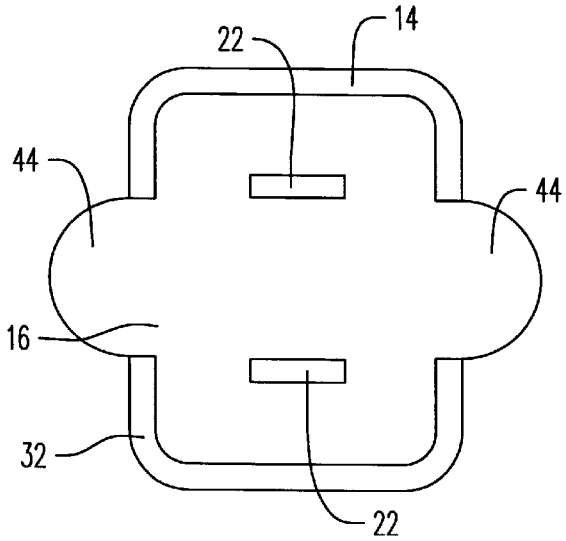
FIG. 9D shows a top view of the electric plug shown in FIG. 9A.

FIGS. 9A to 9D show various views of the core member 16 as engaged with the housing 14. In particular, it can be seen in FIG. 9A that the core member 16 is provided with a slot 94 for insertion of the wire-engagement member 82 in the manner as shown in FIG. 7. As shown in FIG. 9C, a circular cover 96 is engageable with the floor member 30 of the housing 14 to cover the opening 40. Enlarged views of the cover 96 are shown in FIGS. 16A to 16C. On the underside 98 of the circular cover 96 is an elongate depression 100 which allows the application of a screwdriver to screw or unscrew the cover 96 relative to the opening 40. It can be seen in FIGS. 9A and 9B that the opening 40 is aligned with the fuse cavity 50 of the core member 16, so that the fuse 80 may be removed from the plug 10 through the opening 40, when the cover 96 is removed.

Figure 10B:
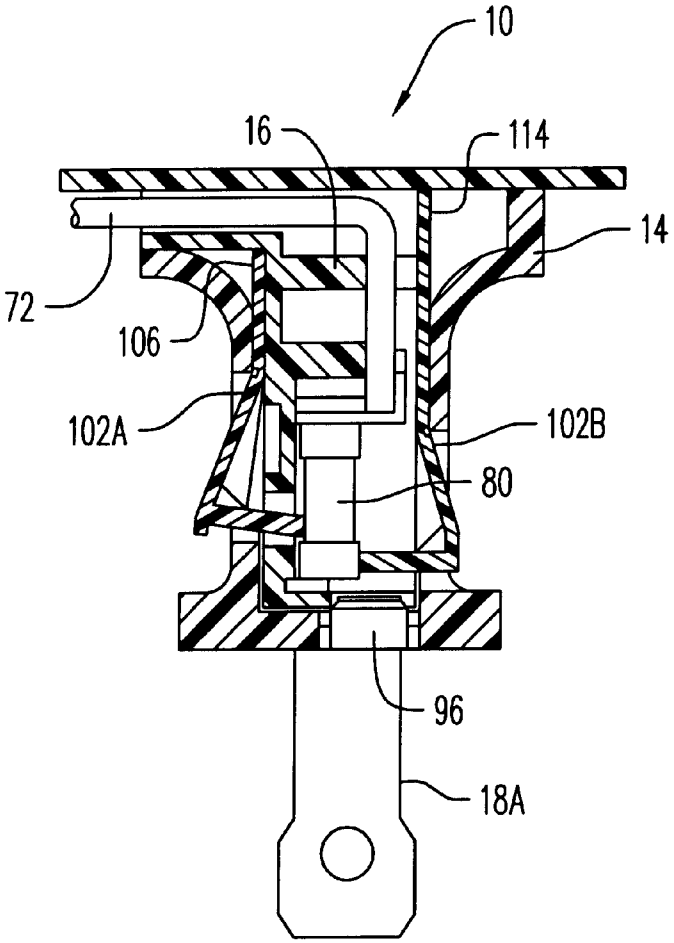
FIG. 10B shows a side half-sectional view of the electric plug shown in FIG. 1.
Figure 10A:
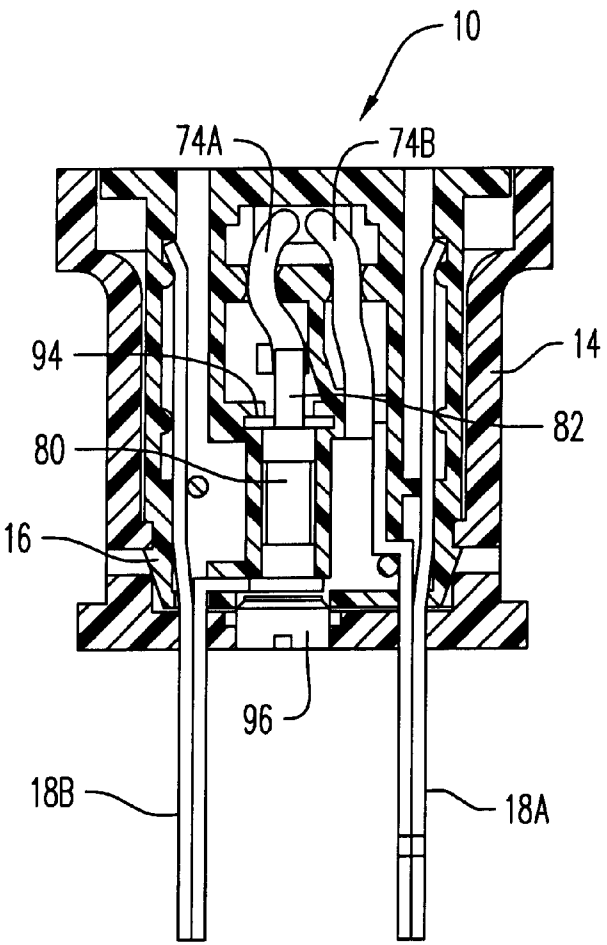
FIG. 10A shows a front half-sectional view of the electric plug shown in FIG. 1.
Figure 12A:
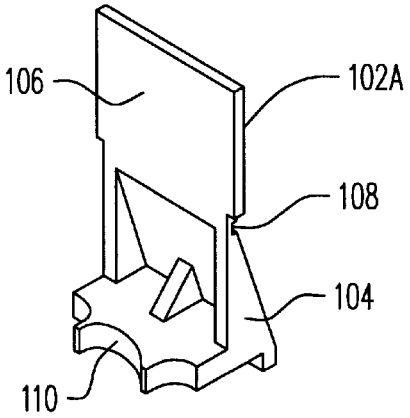
FIG. 12A shows a first switch of the electric plug shown in FIG. 1.
Figure 12B:
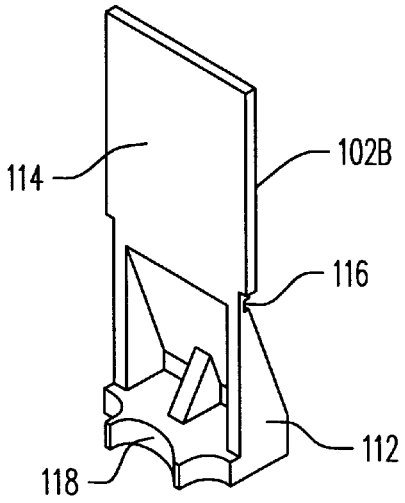
FIG. 12B shows a second switch of the electric plug shown in FIG. 1.

Turning to FIGS. 10A and 10B, longitudinal sectional views of a fully assembled plug 10 are shown. It can be seen in particular in FIG. 10B that two switches 102A and 102B are also assembled to the plug 10. Respective perspective views of the switches 102A and 102B are shown in FIGS. 12A and 12B. The switch 102A includes a switch portion 104 connected to a plate 106. The plate 106 is swivellable relative to the plate 106 about a weakened line 108. On one side of the switch 102A is also provided with an arc portion 110 to engage with part of the surface of the fuse 80. Likewise, the switch 102B also includes a switch portion 112 connected to a plate 114. The plate 112 is swivellable relative to the plate 114 about a weakened line 116. On one side of the switch 102B is also provided with an arc portion 118 to engage with part of the surface of the fuse 80.

It can be seen in FIG. 10B that, the plate 106 of the switch 102A and the plate 114 of the switch 102B are received between the space between the housing 14 and the core member 16. By way of such an arrangement, the switch portions 104 and 112 may swivel relative to the rest of the plug 10. It can also be seen that as the arc portion 110 of the switch 102A and the arc portion 118 of the switch 102B act on opposite sides of the fuse 80, the fuse 80 may be moved between the position shown in solid line and the position shown in dotted line, during the swivelling actions of the switch portions 104, 112. In particular, when the switch portion 112 is pressed toward the housing 14 to the position shown in FIG. 10B, the switch portion 104 of the switch 102A will be pushed to the position as shown, and the fuse 80 will assume the position shown by the solid line. In this position, the fuse 80 is in electrical connection between the leg member 18B and the electric wire 74A of the electric cable 72.

Figure 11:
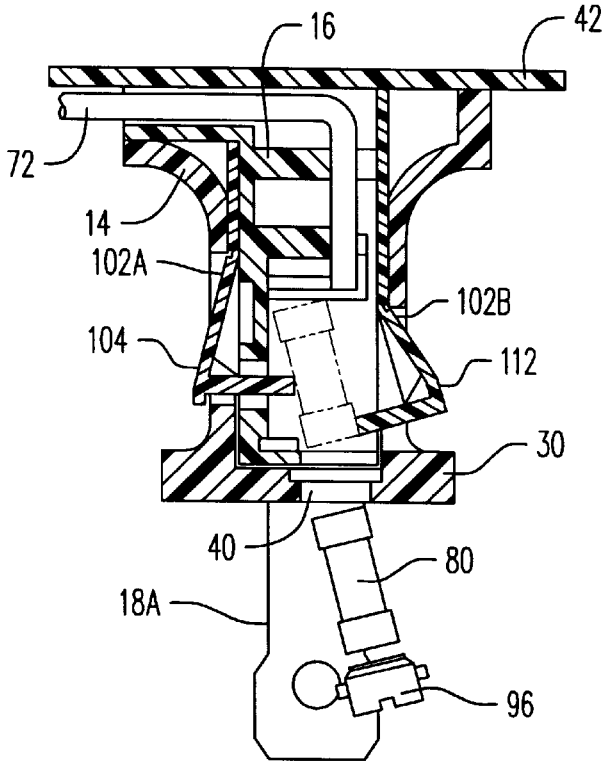
FIG. 11 shows the manner in which the fuse member is removable from the electric plug shown in FIG. 1.

When the switch portion 104 of the switch 102A is pressed toward the housing 14 to the position as shown in FIG. 11, the switch portion 112 of the switch 102B will be moved to the position as shown, and the fuse 80 will then assume the position as shown in dotted line. In this position, the fuse 80 is removed from contact with the leg member 18B, so that the leg member 18B is out of electrical connection with the electric wire 74A of the electric cable 72. In this position, the fuse 80 is also above the opening 40, so that when the cover 96 is removed from the floor member 30 of the housing 14, the fuse 80 can fall from the fuse cavity 50, and away from the plug 10. A new fuse 80 may then be inserted into the fuse cavity 50 and between the respective arc portions 110, 118 of the switches 102A, 102B. When the switch portion 112 is again pressed towards the housing 14 to the position as shown in FIG. 10B, electrical connection between the electric cable 72 and the leg member 18B may again be established via the fuse 80.

What is claimed is:

1. An electric plug comprising a body member to which switching means and at least first and second electrically conductive leg members are mounted, wherein an electric cable comprising at least first and second electric wires is connectable to said body member, wherein said leg members are electrically connectable to a source of electricity, wherein said first leg member is electrically connectable in series with said first electric wire via a fuse member releaseabley attachable to and movable with said switching means, and wherein said switching means is operable to move siad fuse member between a first position in which said fuse member is in electrical connection with said first leg member, and a second position is which said fuse member is out of electrical connectin with said first leg member, wherein said body member comprises a housing member and a core member which is slidably received therein, wherein said fuse member, said switching means and said leg members are carried by said core member, and wherein said housing member comprises a plurality of wall members joined with a bottom member, wherein said bottom member comprises at least two apertures each for receiving therethrough one of said leg members.

2. An electric plug according to claim 1 wherein when said fuse member is in said second position, said fuse member is removable from said body member via an opening of said core member.

3. An electric plug according to claim 2 wherein said opening of said core member is aligned with a hole of said bottom member of said housing member, when said core member is engaged with said housing member.

4. An electric plug according to claim 3 wherein said hole of said bottom member is releasably closable by a cover member.

5. An electric plug according to claim 4 wherein said cover member is releasably engageable with said bottom member of said housing member.

6. An electric plug comprising a body member to which switching means and first and second electrically conductive leg members are mounted, wherein an electric cable comprising at least first and second electric wires is connectable to said body member, wherein said leg members are electrically connectable to a source of electricity, wherein said first leg member is electrically connectable in series with said first electric wire via a fuse member releasably attachable to said switching means, wherein said switching means is movable between a first position in which said first wire is in electrical connection with said first leg member, and a second position in which said first wire is out of electrical connection with said first leg member, and wherein said fuse member is removable from said body member only when said switching means is in said second position wherein said body member comprises a housing member and a core member which is slidably received therein, wherein said fuse member, said switching means and said leg members are carried by said core member, and wherein said housing member comprises a plurality of wall members joined with a bottom member, wherein said bottom member comprises at least two apertures each for receiving therethrough one of said leg members.

7. An electric plug according to claim 6 wherein when said fuse member is in said second position, said fuse member is removable from said body member via an opening of said core member.

8. An electric plug according to claim 7 wherein when said core member is engaged with said housing member, said opening of said core member is aligned with a hole of said bottom member of said housing member.

9. An electric plug according to claim 8 wherein said hole of said bottom member is releasably closable by a cover member.

10. An electric plug according to claim 9 wherein said cover member is releasably engageable with said bottom member of said housing member.

* * * * *